US006221127B1

(12) United States Patent
Rierson

(10) Patent No.: US 6,221,127 B1
(45) Date of Patent: Apr. 24, 2001

(54) METHOD OF PYROPROCESSING MINERAL ORE MATERIAL FOR REDUCING COMBUSTION $NO_X$

(75) Inventor: David W. Rierson, Elm Grove, WI (US)

(73) Assignee: Svedala Industries, Inc., Waukesha, WI (US)

( * ) Notice: Subject to any disclaimer, the term of this patent is extended or adjusted under 35 U.S.C. 154(b) by 0 days.

(21) Appl. No.: 09/438,079

(22) Filed: Nov. 10, 1999

(51) Int. Cl.[7] ..... C21B 13/08; C22B 1/216

(52) U.S. Cl. ..... 75/477; 75/482; 75/762; 75/763

(58) Field of Search ..... 75/474, 482, 762, 75/763, 477; 266/173, 177, 168

(56) References Cited

U.S. PATENT DOCUMENTS

| | | | | |
|---|---|---|---|---|
| 1,121,906 | | 12/1914 | Downs . | |
| 2,941,791 | | 6/1960 | Wienert | 263/33 |
| 3,182,980 | | 5/1965 | Helfrich | 263/33 |
| 3,580,554 | | 5/1971 | Bushuev et al. | 263/33 |
| 3,661,370 | | 5/1972 | Rossi | 263/33 |
| 3,753,682 | * | 8/1973 | Kohl | 75/3 |
| 3,794,483 | | 2/1974 | Rossi | 75/91 |
| 3,831,913 | * | 8/1974 | Ando et al. | 266/24 |
| 4,070,149 | | 1/1978 | Rossi | 432/109 |
| 4,208,181 | * | 6/1980 | Rossi | 432/109 |
| 4,209,292 | | 6/1980 | Rossi | 432/105 |
| 4,373,909 | | 2/1983 | Petit et al. | 432/109 |
| 4,462,793 | | 7/1984 | Maeda et al. | 432/14 |
| 4,496,306 | * | 1/1985 | Okigami et al. | 431/8 |
| 5,248,330 | * | 9/1993 | Rierson | 75/746 |
| 5,344,307 | | 9/1994 | Schwartz et al. | 431/9 |
| 5,683,238 | | 11/1997 | Snyder | 431/8 |

* cited by examiner

*Primary Examiner*—Roy King
*Assistant Examiner*—Tima McGuthry-Banks
(74) *Attorney, Agent, or Firm*—Andrus, Sceales, Starke & Sawall LLP

(57) ABSTRACT

A method of pyroprocessing mineral ores, such as iron ore. The method includes receiving a preheated product stream of iron-containing pellets at an infeed end of a rotary kiln and introducing an oxidizing gas into the tumbling bed toward the infeed end of the rotary kiln. Additionally, a combustible fuel is introduced through ports above the tumbling bed such that combustion of the introduced fuel increases the temperature of the product stream toward the infeed end. The increase in the temperature of the product stream allows the intensity of the flame from the centerline burner to be decreased, resulting in a reduction in the production of $NO_x$. The apparatus for introducing both the oxidizing gas and fuel into the rotary kiln are common with each other.

13 Claims, 4 Drawing Sheets

FIG. 5
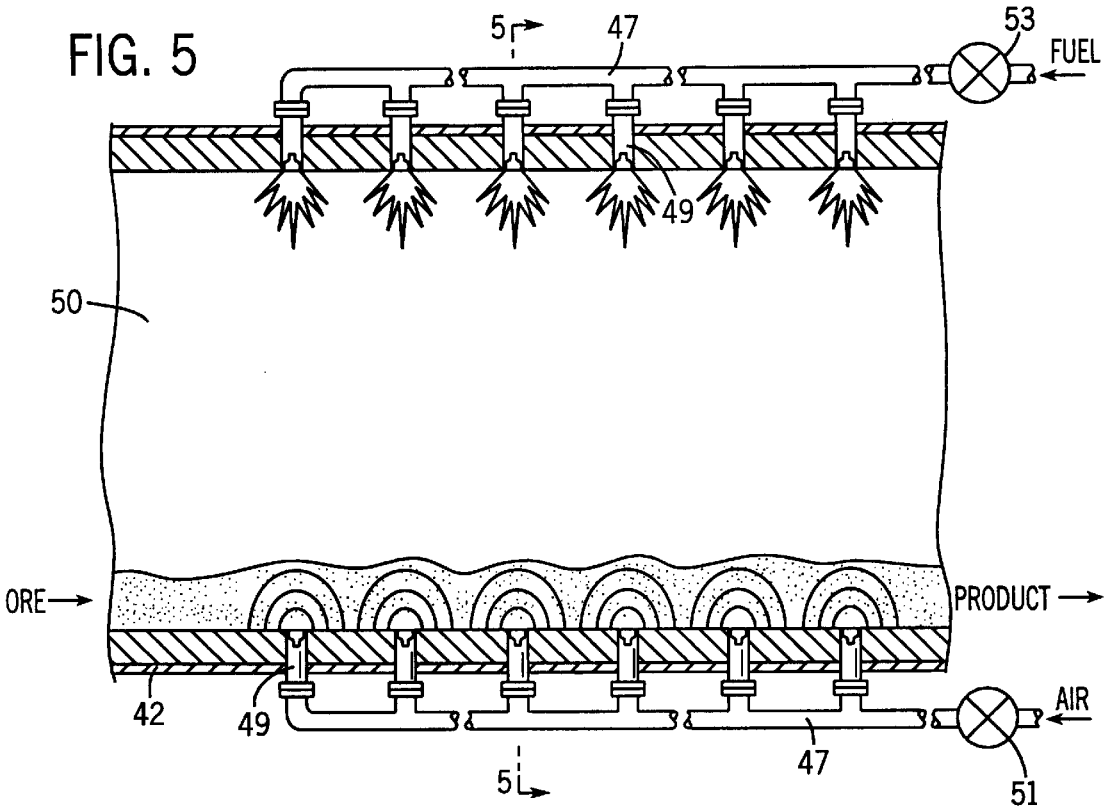
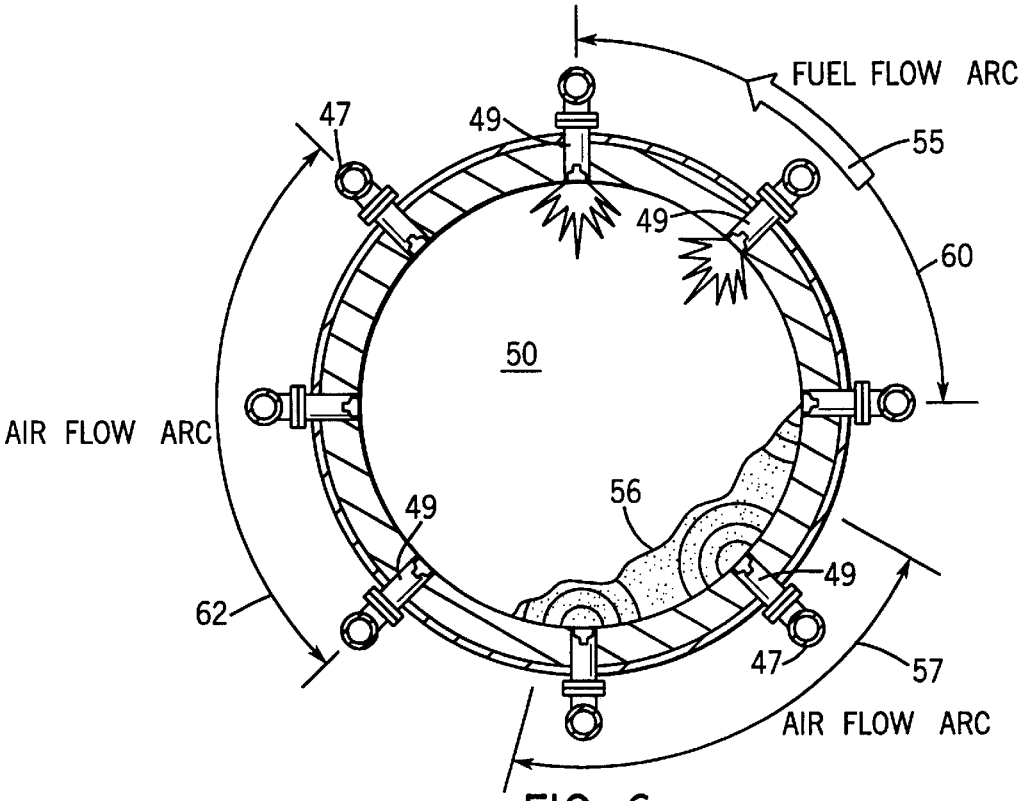
FIG. 6

METHOD OF PYROPROCESSING MINERAL ORE MATERIAL FOR REDUCING COMBUSTION $NO_X$

BACKGROUND OF THE INVENTION

The present invention generally relates to the conversion of fine grained iron ore pellets into hardened iron oxide pellets suitable as a feed material for making steel. More specifically, the present invention relates to a rotary kiln useful in heat hardening the iron ore pellets while reducing the overall fuel consumption and $NO_x$ production. More generally, the present invention relates to a high temperature rotary kiln process where a longitudinal distribution of air and fuel along the length of the kiln enhances the processing condition of the solids being treated.

It is well known that most mineral ores in their natural state are low in concentration relative to a specific element and therefore require beneficiation which renders this material ore to a fine, powdery consistency. In the case of magnetite and hematite iron ores, this fine powdery state is unsuitable for transportation and many times unsuitable for further processing such as a feed to blast furnaces, open hearth furnaces or electric arc furnaces. A number of methods have been tried, with varying degrees of success, for agglomerating such fine ore particles to make the particles more suitable for handling, shipment and use in downstream processing equipment. In the following discussion, magnetite ore will be used as the feed material in the illustrations provided.

A well known agglomerating method involves converting the fine, powdery ore into balls or pellets that are transferred onto a traveling grate where the pellets are subjected to a cross-flow of hot gases to dry and pre-harden the pellets. While being heated, the iron ore pellets begin to oxidize, at which time the magnetite ($Fe_3O_4$) phase of iron begins to transform into hematite ($Fe_2O_3$). The pellets are then discharged from the traveling grate into a directly fired rotary kiln where the pellets are tumbled and subjected to further heating by a centerline burner in a counter-flowing oxidizing atmosphere with temperatures ranging between 2200–2450° F. The pellets are subsequently discharged into an annular cooler where they are further oxidized to the point of almost 100% oxidation. Since the oxidation of the ore is an exothermic reaction, the further oxidation of the product stream in the annular cooler raises the temperature within the cooler, which decreases its cooling efficiency.

The Rierson U.S. Pat. No. 5,248,330, incorporated herein by reference, improves upon the above-identified, generally known process by introducing an oxidizing gas, such as air, beneath the bed of pellets within the rotary kiln such that the oxidizing gas flows radially upward through the tumbling bed of pellets. The radially injected under-bed oxidizing gas intimately contacts the surface of the tumbling pellets and oxidation occurs. The process disclosed in the Rierson '330 patent causes nearly the entire oxidation to occur before the annular cooler, which relieves the burden on the downstream cooler, in which 30–40% of the oxidation previously occurred. The introduction of the oxidizing gas into the rotary kiln causes the oxidation to occur within the rotary kiln rather than in the annular cooler, which allows the annular cooler to operate more efficiently in cooling the iron oxide product.

Although the disclosure of the Rierson '330 patent has proved to be successful, a problem exists in the amount of $NO_x$ produced during the transformation of the magnetite into hematite. Specifically, the high temperature firing of the centerline burner required to maintain the temperature within the rotary kiln generates a significant amount of $NO_x$, which is considered to be an environmental pollutant. The production of $NO_x$ occurs due to the high intensity firing of the centerline burner contained within the rotary kiln.

Therefore, it is an object of the present invention to decrease the amount of $NO_x$ produced during the oxidation of mineral ores such as magnetite. An additional object of the invention is to provide a system for oxidizing ores using a traveling grate and rotary kiln in which the ore is substantially oxidized prior to being discharged from the rotary kiln. Further, it is an object of the present invention to maintain the level of oxidation of iron ore prior to its introduction into the cooler while at the same time reducing the external fuel consumption and decreasing the $NO_x$ production.

SUMMARY OF THE INVENTION

The present invention is a method and apparatus for use in oxidizing an iron ore product stream. The rotary kiln of the invention includes a plurality of fuel distribution pipes that are positioned along a portion of the outer surface of the rotary kiln. The fuel distribution pipes are each associated with a supply pipe having a plurality of individual ports that provide a flow passageway from the fuel distribution pipe to the open interior of the rotary kiln.

Each of the fuel distribution pipes extending along the exterior of the rotary kiln is coupled to a common fuel distribution manifold through a fuel valve. The fuel valve can be selectively operated between a closed position to prevent the flow of fuel into the associated supply pipe and thus the open interior of the rotary kiln or an open position to allow the fuel to flow through the associated supply pipe and into the kiln interior.

In addition to the plurality of fuel distribution pipes, the rotary kiln of the present invention includes a plurality of air distribution pipes positioned adjacent to the fuel distribution pipes along the outer surface of the rotary kiln. The air distribution pipes are also each associated with one of the supply pipes having a plurality of individual ports that provide the flow passageway into the open interior of the rotary kiln. Thus, the ports serve the dual function of providing the flow passageway into the kiln for both fuel and air at different times during the rotation of the kiln.

Each of the air distribution pipes extending along the exterior of the rotary kiln is coupled to a second and independent air distribution manifold through an air valve. Each of the air valves can be selectively operated between a closed position to prevent the flow of air into the associated supply pipe and an open position to allow air to flow through the associated supply pipe and into the kiln interior. The fuel and air distribution systems discussed above are completely independent from each other and are designed to permit flow into the kiln's interior at different angular orientations as the rotary kiln rotates.

The air valves spaced around the circumference of the rotary kiln and positioned in the air distribution pipes are each operated in accordance with the invention to allow the oxidizing gas (air) to enter into the open interior of the rotary kiln when the rows of ports associated with the air distribution pipe are in the appropriate angular position(s). In the case where magnetite is being processed, air can be introduced when the rows of ports are oriented both under the bed and over the bed. When air is introduced under the bed, the oxidizing gas flows radially upward through the tumbling product stream to aid in the oxidation process of the product stream. When the oxidizing gas (air) is introduced above the bed, the air aids in the combustion of fuel added to the over bed space.

As the kiln continues to rotate, each of the fuel valves positioned in the fuel distribution pipes are opened to allow fuel to flow through the associated supply pipe and associated rows of ports when the fuel distribution pipe and rows of ports are positioned above the product stream bed. The fuel valve remains open to allow fuel to flow into the open interior during a predetermined fuel flow arc of travel. The introduction and distribution of fuel above the product stream causes the fuel to combust over the length of the ported zone and within the heated, oxidizing environment contained in the open interior of the rotary kiln.

Combustion of the fuel introduced, with air, through the rows of ports above the product stream bed lengthens the hot zone temperature of the product stream. This is not an intense combustion zone and is therefore without the production of $NO_x$. The increase in temperature of the product stream near the infeed end of the rotary kiln allows the amount of fuel consumed by the centerline burner to decrease while still providing the required temperature within the rotary kiln. The amount of fuel no longer required by the centerline burner can be diverted to the ports such that the introduction of fuel near the infeed end does not increase the total amount of fuel consumed by the rotary kiln process. The decrease in fuel consumption by the centerline burner results in a decrease in the intensity of the flame produced by the centerline burner, thereby decreasing the amount of $NO_x$ produced in this process.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 5 is a partial section view of the rotary kiln of the present invention illustrating the introduction of an oxidizing gas into the product stream and fuel into the open interior of the rotary kiln above the product stream; and FIG. 6 is a section view taken along line 6—6 of FIG. 4 illustrating the introduction of air and fuel into the rotary kiln through the common induction ports.

DETAILED DESCRIPTION OF THE INVENTION

Figure 1:
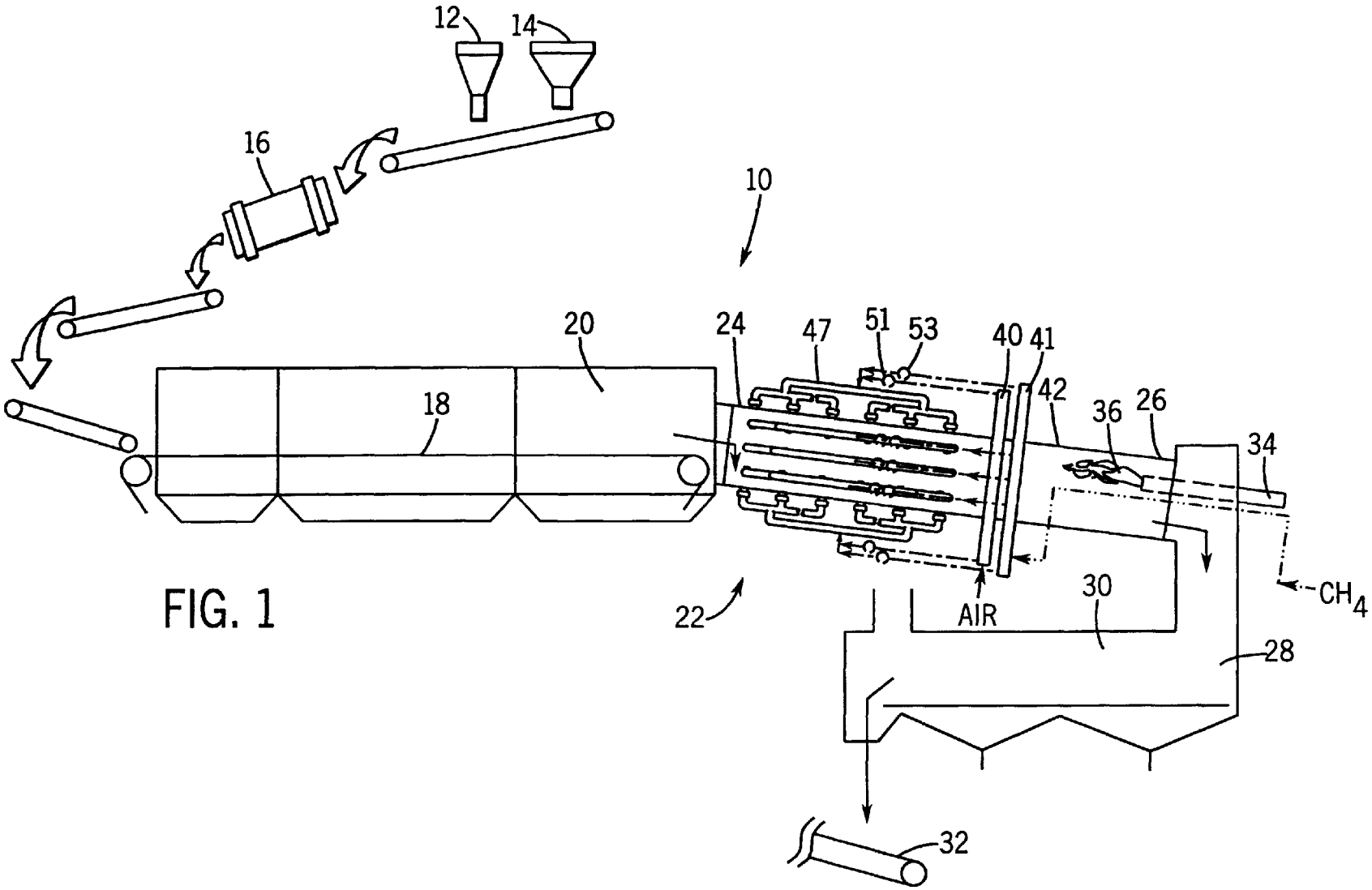
FIG. 1 is a schematic illustration of an iron ore processing system including a rotary kiln of the present invention for reducing the production of $NO_x$.

FIG. 1 illustrates a processing system 10 used to oxidize a wide variety of lump ores or pellets to produce an oxidized product stream. In the preferred embodiment of the invention, the processing system 10 will be discussed in connection with an iron ore (magnetite) pelletizing product stream. The processing system 10 includes a supply of a binder from bin 12 and a supply of ore fines from a bin 14 that are combined to form green balls in a balling drum 16. The green balls of metal-bearing material are deposited on a traveling grate 18 that travels through a furnace 20. The furnace 20 is divided into drying and preheating zones such that the pellets on the traveling grate 18 are exposed to a cross-flow of hot oxidizing gases that dry and harden the pellets in preparation for transfer to a rotary kiln 22. The pellets must be sufficiently strengthened through heat hardening before reaching the rotary kiln 22 to avoid breaking and crumbling of the pellets.

When the pellets are on the traveling grate 18, hot oxidizing gas from the rotary kiln 22 is drawn through the bed of pellets to harden the pellets and to begin the oxidizing process. In the preheating zone of the furnace 20, the pellets are heated to between 1600–2000° F. Typically, approximately 60–70% of the total oxidation of the iron ore pellets occurs while the pellets are on the traveling grate 18 within the furnace 20.

After the pellets have passed completely through the furnace 20, the pellets are delivered to an infeed end 24 of the rotary kiln 22. The rotary kiln 22 is inclined such that as the rotary kiln rotates, the pellets form a continuous product stream that is urged to travel from the infeed end 24 to a discharge end 26 of the rotary kiln 22. The amount of time each pellet remains in the rotary kiln 22 is determined by the slope of the kiln and the rate of rotation. As an illustrative example, each pellet may remain in the kiln 22 for 20–40 minutes.

While the product stream of iron ore pellets is contained within the rotary kiln 22, the iron ore is further oxidized by the introduction of an oxidizing gas, such as air, beneath the bed of pellets such that approximately 99% of the total oxidation of the pellets from magnetite ($Fe_3O_4$) to hematite ($Fe_2O_3$) occurs prior to the product stream reaching the discharge chute 28. The discharge chute 28 transfers the hot oxidized product stream to an annular cooler 30 that cools the oxidized product stream before its discharge onto a conventional product handling system 32 consisting of conveyors, screens and bins.

Figure 2:
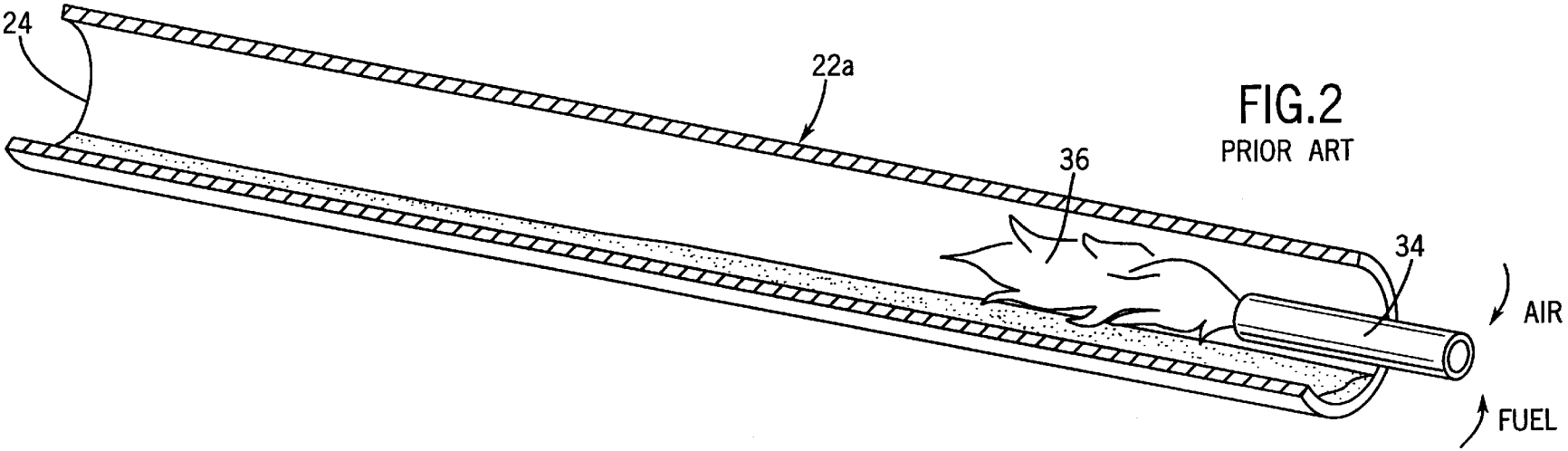
FIG.2 PRIOR ART
FIG. 2 is a perspective view, including a partial section, illustrating a prior art rotary kiln.

Referring now to FIG. 2, in a conventional, prior art rotary kiln 22*a*, the product stream enters into the infeed end of the rotary kiln 22*a* and proceeds through the rotary kiln 22*a* toward a centerline burner 34. The centerline burner 34 generates a flame 36 that provides the required heat within the rotary kiln 22*a* to indurate the ore pellets contained in the product stream. As can be seen by the temperature profile line 37 in the graph of FIG. 3, the temperature of the solids within the product stream increases as the product stream nears the centerline burner 34 and peaks at point 38 which is generally aligned with the flame 36 of the centerline burner 34. In the prior art processing systems including the rotary kiln 22*a*, the remaining 30–40% of the oxidation of the pellets occurred in a downstream cooler. Since the oxidation process is exothermic, the oxidation of the pellets in the cooler obviously decreases the efficiency of the cooler.

Although the rotary kiln 22*a* shown in FIG. 2 has proven effective in an overall system for indurating the ore contained in the product stream, the high intensity of flame 36 generates $NO_x$, such as NO or $NO_2$, which is considered an environmental pollutant. As an example, the flame 36 may burn at 3000° F. to create an ambient temperature of 2400° F. in the rotary kiln 22*a*. It is well known that the intensity of the flame 36, not the amount of fuel consumed by the centerline burner 34, is critical in determining the amount of $NO_x$ formed in the rotary kiln 22.

Figure 4:
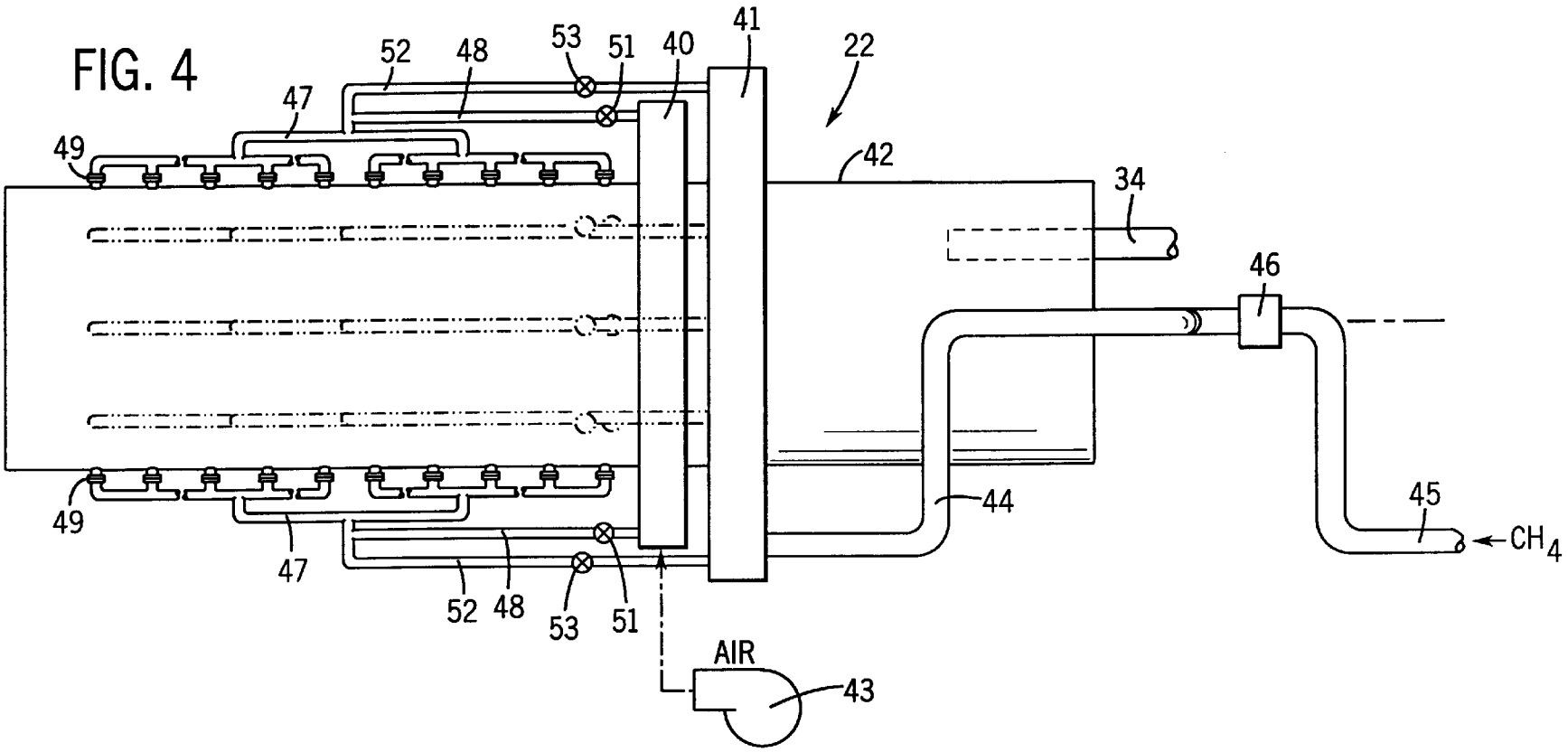
FIG. 4 is a schematic illustration of the rotary kiln of the present invention illustrating the fuel distribution pipes and air distribution pipes for introducing air and fuel into the interior of the rotary kiln.

Referring now to FIGS. 1 and 4, the rotary kiln 22 of the present invention includes an air distribution manifold 40 and a fuel distribution manifold 41 that each surround the outer circumference of the shell 42 of the rotary kiln 22. The air distribution manifold 40 is coupled to a supply of oxidizing gas and the fuel distribution manifold 41 is coupled to a supply of fuel. In the preferred embodiment of the invention, the oxidizing gas is air that is supplied through a conventional blower 43.

Referring now to FIG. 4, in the preferred embodiment of the invention, the supply of fuel is a supply of fluid, which could be natural gas ($CH_4$), supplied to the fuel distribution manifold 41 by a fuel supply pipe 44. The fuel supply pipe 44 is connected to a fuel-on system 45 by a rotary union connection 46.

As can be seen in FIGS. 1 and 4, a plurality of supply pipes 47 extend along the exterior of the rotary kiln. Each of the supply pipes 47 includes a row of spaced ports 49 that extend from the respective supply pipe 47 through an opening formed in the shell 42 of the rotary kiln. The ports 49 are equally spaced along the supply pipe 47 and provide a pathway for either fuel or oxidizing gas to pass from the supply pipe 47 into an open interior 50 of the rotary kiln 22, as shown in FIG. 5. In the preferred embodiment of the invention, 8–12 individual supply pipes 47 are equally spaced around the circumference of the shell 42.

Each of the supply pipes 47 is connected to the air distribution manifold 40 by an air distribution pipe 48. Since the rotary kiln 22 includes 8–12 supply pipes 47, the same number of air distribution pipes 48 are also spaced along the outer circumference of the rotary kiln 22 and connected to a corresponding supply pipe 47.

Each air distribution pipe 48 includes its own air valve 51 that is selectively operable to control the flow of air from the air distribution manifold 40 to the associated supply pipe 47. Each air valve 51 can either be closed to prevent air flow from the air distribution manifold 40 to the supply pipe 47 or opened to permit air to flow from the air distribution manifold 40, through the air distribution pipe 48, and into the associated supply pipe 47.

Referring back to FIGS. 1 and 4, the fuel distribution manifold 41 is connected to the same plurality of supply pipes 47 by a corresponding number of fuel distribution pipes 52. Each fuel distribution pipe 52 extends between the fuel distribution manifold 41 and one of the supply pipes 47 spaced around the outer circumference of the outer shell 42 of the rotary kiln 22. Each fuel distribution pipe 52 includes its own fuel valve 53 that can be selectively opened or closed. When the fuel valve 53 is closed, the fuel valve 53 prevents the flow of fuel from the fuel distribution manifold 41 into the open interior of the rotary kiln 22 through the associated row of ports 49. When the fuel valve 53 for each fuel distribution pipe 52 is opened, fuel can flow from the fuel distribution manifold 41, through the fuel distribution pipe 52, and into the open interior of the rotary kiln through the associated supply pipe 47 and ports 49. As can be understood in FIGS. 1 and 4, the fuel distribution pipes 52 and air distribution pipes 48 are positioned adjacent to each other and are connected to the same supply pipes 47. In this manner, the plurality of supply pipes 47 and corresponding rows of ports 49 provide a passageway for both fuel and air into the open interior 50 of the rotary kiln 22.

In the preferred embodiment of the invention and for this specific oxidation process, the combined length of the port system is approximately ½ of the overall length of the rotary kiln 22. As shown in FIG. 1, each of the supply pipes 47 terminates toward the infeed end 24 of the rotary kiln 22.

Referring now to FIG. 6, as the rotary kiln 22 rotates in the direction shown by arrow 55, the air valve 51 for each air distribution pipe 48 is opened to allow oxidizing gas to flow through the air distribution pipes 48 and associated supply pipes 47 including the ports 49 when the associated supply pipe 47 is beneath the product stream 56 contained within the rotary kiln, as indicated by the air flow arc 57. In the preferred embodiment of the invention, each air valve 51 is opened to allow the passage of oxidizing gas when the supply pipe 47 nears the six o'clock position and the air valve 51 is closed when the supply pipe 47 is between the three o'clock and the six o'clock position during rotation of the rotary kiln 22. The resultant air flow arc 57 illustrated in FIG. 6 ensures that the oxidizing gas is introduced beneath the product stream such that the oxidizing gas flows radially upward through the tumbling bed to improve the contact between the oxidizing gas and the tumbling pellets in the product stream and to cause oxidation to occur.

Since oxidation of the iron ore pellets is an exothermic reaction, the simple introduction of the oxidizing gas into the tumbling product stream toward the infeed end 24 of the rotary kiln 22 results in an increase in the temperature within the rotary kiln 22. This elevation in the temperature within the rotary kiln decreases the amount of heat required from the centerline burner 34 to drive the oxidizing reaction and complete pellet induration. This decrease in fuel causes a decrease in the production of $NO_x$.

As the rotary kiln 22 continues to rotate in the direction shown by arrow 55, the fuel valve 53 for each fuel distribution pipe 52 is opened to allow fuel to flow through the fuel distribution pipe 52 and associated supply pipe 47 including the ports 49 when the supply pipe 47 passes through a fuel flow arc of rotation 60. As the ports 49 pass through the fuel flow arc 60, the fuel is introduced into the kiln's overbed space.

In addition to the introduction the oxidizing gas directly into the product stream 56 during the air flow arc 57, each of the air valves 51 is opened a second time to allow air from the air distribution manifold 40 to be introduced into the supply pipes 47 and pass through the ports 49 during rotation of the kiln 22 through a flow arc 62. The air introduced through the ports 49 during rotation through the second flow arc 62 is introduced above the bed of pellets such that the air mixes with the fuel that was introduced during the fuel flow arc 60. The fuel introduced through the ports 49 mixes with the oxygen contained in the open interior 50 and combusts within heated open interior 50. The combustion of the fuel within the open interior 50 further increases the temperature toward the infeed end of the rotary kiln 22, as illustrated by the temperature profile line 61 in the graph of FIG. 3.

Figure 3:
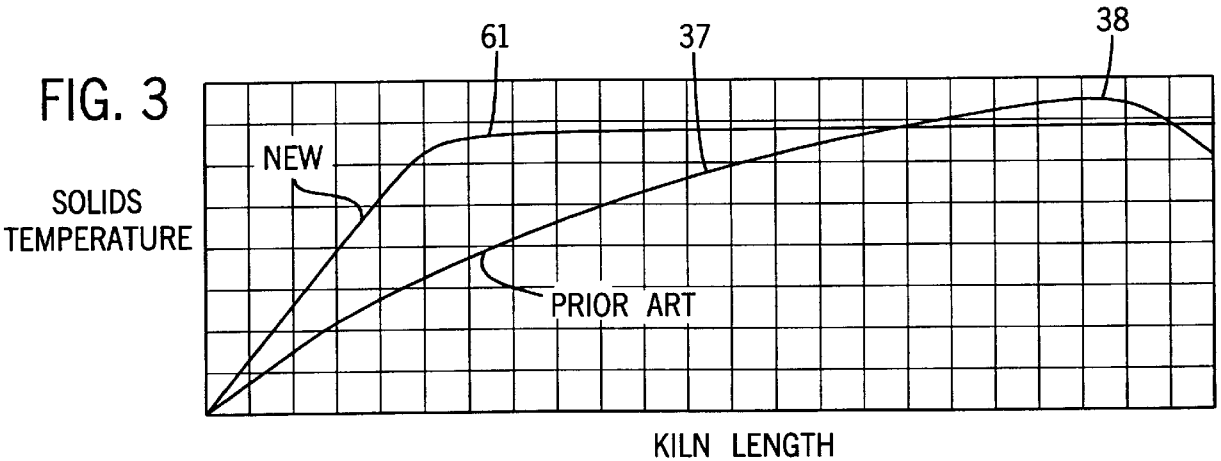
FIG. 3 is a graphic depiction of the temperature profile as the product stream travels along the length of the kiln for both the prior art system of FIG. 2 and the rotary kiln illustrated in FIG. 1.

As the temperature profile line 61 in FIG. 3 illustrates, the temperature of the solids within the product stream rapidly increases toward the infeed end of the rotary kiln 22 as compared to the prior art system including only the centerline burner 34. Because of the increase in temperature near the infeed end 24 due to both the introduction of the oxidizing gas beneath the product bed and the introduction of fuel and air above the product bed, the intensity of the flame 36 of the centerline burner 34 can be reduced while the temperature within the kiln remains at approximately 2400° F. The reduction in the flame intensity of the centerline burner 34 decreases the amount of $NO_x$ produced within the rotary kiln 20 and also reduces the amount of fuel consumed by the centerline burner 34. The fuel savings from the centerline burner 34 can be diverted to the ports 52 and introduced into the rotary kiln along the fuel flow arc 60. In this manner, the total fuel consumption for the entire system remains generally the same or can be slightly reduced.

Although not shown in the Figures or described in the above description, appropriate control mechanisms are provided around the outer circumference of the rotary kiln 22 to open and close the air valves 51 and the fuel valves 53 so that the oxidizing gas and fuel are injected when the ports 49 are in the desired positions as indicated by the air flow and fuel flow arcs of FIG. 6. In a proposed embodiment of the invention, each of the air valves 51 and fuel valves 53 can be a conventional tripper valve whose opening and closing is controlled by a conventional tripper mechanism. Such a system, including the valves and nozzles, is disclosed in U.S. Pat. No. 3,946,949. Conventional tripper valves and tripper mechanisms are well known in the industry and their details will not be discussed in the present disclosure.

As can be understood by the foregoing description, the introduction of air and fuel above the product stream toward the infeed end of the rotary kiln increases the temperature within the kiln. The increase in temperature toward the infeed end of the rotary kiln allows the centerline burner 34 to maintain the product stream at a desired temperature by using a centerline flame 36 having a decreased intensity. Although the centerline flame 36 still produces some $NO_x$, the amount of $NO_x$ produced is reduced without any adverse affects in the process of iron oxide pellet induration.

Various alternatives and embodiments are contemplated as being within the scope of the following claims particularly pointing out and distinctly claiming the subject matter regarded as the invention.

I claim:

1. A method of oxidizing a mineral ore passing through an inclined rotary kiln comprising the steps of:

receiving the mineral ore at an infeed end of the rotary kiln so that the mineral ore forms a continuous tumbling product stream proceeding from the infeed end to a discharge end of the rotary kiln;

positioning a burner near the discharge end of the rotary kiln;

operating the burner to maintain the temperature in the rotary kiln at a level sufficient to achieve oxidation and induration of the mineral ore;

positioning a plurality of ports along the rotary kiln;

injecting an oxidizing gas through the plurality of ports when the ports are beneath the product stream to increase the gas-ore interaction; and injecting a fuel through the plurality of ports only when the ports are above the product stream such that the fuel burns above the product stream to elevate the temperature in the rotary kiln, wherein the oxidizing gas and the fuel are injected alternately through the same ports as the rotary kiln rotates.

2. The method of claim 1 wherein the mineral ore is iron ore.

3. The method of claim 1 wherein the oxidizing gas is air.

4. The method of claim 1 wherein the oxidizing gas and fuel are introduced into the rotary kiln toward the infeed end of the rotary kiln.

5. The method of claim 1 wherein the ports are aligned in a series of rows spaced about the circumference of the rotary kiln, each row of ports being coupled to an air valve controlled to supply the oxidizing gas beneath the product stream and a fuel valve controlled to supply the fuel above the product stream.

6. A method of oxidizing iron ore passing through an inclined rotary kiln comprising the steps of:

receiving the iron ore at an infeed end of the rotary kiln so that the iron ore forms a continuous tumbling product stream proceeding from the infeed end to a discharge end of the rotary kiln;

positioning a burner near the discharge end of the rotary kiln;

operating the burner to burn a supply of fuel and maintain the temperature in the rotary kiln at a level sufficient to achieve oxidation and induration of the iron ore;

positioning a plurality of supply pipes along the exterior of the rotarty kiln, each supply pipe connected to a plurality of ports extending into the interior of the rotary kiln;

attaching an air distribution pipe to each of the supply pipes, each air distribution pipe being coupled to a supply of oxidizing gas through an air valve;

attaching a fuel distribution pipe to each of the supply pipes, each fuel distribution pipe being coupled to a supply of fuel through a fuel valve;

opening the air valve for each air distribution pipe to supply the oxidizing gas to the associated supply pipe as the ports of the supply pipe rotate through a first air flow arc, the first air flow arc being a portion of the rotation of the rotary kiln when the ports of the supply pipe are beneath the product stream such that the oxidizing gas is injected beneath the product stream; and opening the fuel valve for each fuel distribution pipe to supply the fuel to the associated supply pipe as the ports of the supply pipe rotate through a fuel flow arc, the fuel flow arc being a portion of the rotation of the rotary kiln when the ports of the supply pipe are above the product stream such that the fuel is injected above the product stream and burns above the product stream to elevate the temperature in the rotary kiln.

7. The method of claim 6 further comprising the step of diverting a portion of the supply of fuel from the burner to the fuel distribution pipes such that the diverted portion of the supply of fuel is burned above the product stream.

8. The method of claim 6 wherein the plurality of ports are each located toward the infeed end of the rotary kiln such that the burned fuel increases the temperature in the rotary kiln near the infeed end.

9. The method of claim 6 further comprising the step of opening the air valve for each air distribution pipe as the ports of the supply pipe rotate through a second air flow arc, the second air flow arc being a portion of the rotation of the rotary kiln when the ports of the associated supply pipe are above the product stream, wherein the second air flow arc starts after the end of the fuel flow arc and before the beginning of the first air flow arc.

10. The method of claim 9 wherein each supply pipe receives both the oxidizing gas and the fuel.

11. The method of claim 6 further comprising the steps of:

positioning an air distribution manifold around the exterior of the rotary kiln, the air distribution manifold being coupled to the supply of oxidizing gas and each of the air valves; and positioning a fuel distribution manifold around the exterior of the rotary kiln, the fuel distribution manifold being coupled to the supply of fuel and each of the fuel valves.

12. A method for oxidizing iron ore in a rotary kiln, wherein the rotary kiln includes a burner operated to maintain the temperature in the kiln at a level sufficient to achieve oxidation and induration and a plurality of supply pipes positioned along the exterior of the rotary kiln, each supply pipe connected to a plurality of ports extending into the interior of the rotary kiln and coupled to a supply of oxidizing gas through an air valve that is selectively operable to supply the oxidizing gas through the ports of the supply pipe as the ports rotate through a first air flow arc, the first air flow arc being a portion of rotation of the rotary kiln when the ports are beneath the bed of iron ore, the method comprising the steps of:

coupling a supply of fuel to the plurality of supply pipes through a plurality of fuel values;

opening the fuel valve to supply the fuel to the associated supply pipe only as the ports of the supply pipe rotate through a fuel flow arc, the fuel flow arc being a portion of rotation of the rotary kiln when the ports of the supply pipe are above the product stream such that the fuel bums above the product stream to elevate the temperature in the rotary kiln; and opening the air valve for each air distribution pipe as the ports of the supply pipe rotate through a second air flow arc, the second air flow arc being a portion of the rotation of the rotary kiln when the ports of the associated supply pipe are above the product stream, wherein the second air flow arc starts after the end of the fuel flow arc and before the beginning of the first air flow arc.

13. The method of claim 12 further comprising the step of diverting a portion of the fuel from the burner to the supply pipes for introduction into the rotary kiln through the ports during the fuel flow arc, whereby the diversion of the fuel from the burner to the supply pipes decreases the intensity of the burner's flame and reduces the production of $NO_x$.

* * * * *